US008213813B2

(12) United States Patent
Gross et al.

(10) Patent No.: US 8,213,813 B2
(45) Date of Patent: Jul. 3, 2012

(54) SYSTEMS AND METHODS FOR REDUCING VELOCITY ERRORS IN A MOVABLE IMAGE CARRIER OF AN IMAGE FORMING DEVICE

(75) Inventors: Eric M. Gross, Rochester, NY (US); Charles A. Radulski, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 450 days.

(21) Appl. No.: 12/511,509

(22) Filed: Jul. 29, 2009

(65) Prior Publication Data

US 2011/0026952 A1 Feb. 3, 2011

(51) Int. Cl.
*G03G 15/00* (2006.01)

(52) U.S. Cl. ..... 399/44; 399/167

(58) Field of Classification Search ..... 399/38, 399/44, 45, 66, 159, 162, 167, 301–303
See application file for complete search history.

(56) References Cited

U.S. PATENT DOCUMENTS

| | | | | |
|---|---|---|---|---|
| 6,832,066 | B2 * | 12/2004 | Watanabe et al. | 399/299 |
| 7,157,873 | B2 | 1/2007 | Carolan | |
| 7,379,680 | B2 | 5/2008 | Calamita | |
| 7,406,282 | B2 * | 7/2008 | Inui et al. | 399/299 |
| 7,444,101 | B2 | 10/2008 | Calamita | |
| 7,657,214 | B2 * | 2/2010 | Inui et al. | 399/299 |

* cited by examiner

*Primary Examiner* — Hoan Tran
(74) *Attorney, Agent, or Firm* — Oliff & Berridge, PLC

(57) ABSTRACT

Systems and methods apply active feedback via a repetitive controller to compensate for periodic disturbances applied by recording media to a movable image carrier having a controlled velocity. The compensation parameters of the repetitive controller, once the error signal of the feedback converges to zero, can be stored with one or more characteristics of the print job or the recording media used for the print job. When other print jobs are received having the same one or more characteristics, the stored, converged compensation parameters can be retrieved, reducing the time to convergence of the systems and methods.

20 Claims, 6 Drawing Sheets

SYSTEMS AND METHODS FOR REDUCING VELOCITY ERRORS IN A MOVABLE IMAGE CARRIER OF AN IMAGE FORMING DEVICE

BACKGROUND

This disclosure is directed to systems and methods for measuring velocity errors and reducing torque disturbances in movable image carriers of image forming devices.

A variety of systems and methods are conventionally used for velocity control for movable image carriers, such as photoreceptors or intermediate transfer belts or drums, in image forming devices. Prior solutions include use of highly inertial photoreceptor drums or highly inertial photoreceptor belt rollers that reduce the effects of disturbances. Further systems and methods can include classically designed velocity feedback systems supplemented by a periodic feed-forward control scheme.

Speed of a movable image carrier motor drive unit must generally be tightly controlled. Generally, movable image carrier velocity sensors sense any increase or decrease in velocity of the movable image carrier motor drive unit. A motor control device reacts to readjust the speed of the movable image carrier motor drive unit and, thus, the movable image carrier.

U.S. Pat. No. 7,379,680, entitled "Systems and Methods for Determining Feed Forward Correction Profile For Mechanical Disturbances In Image Forming Devices" by James Calamita, which is commonly assigned, discloses a control system to automate and/or adapt feed-forward correction (FFC) profile to match precisely the timing and nature of a torque disturbance in a transfer subsystem, which may reduce or substantially nullify torque disturbances, such as, for example, torque disturbances caused by a photoreceptor belt seam passing over an acoustic transfer assist (ATA) unit in a photoreceptor belt-based transfer subsystem in an electrophotographic and/or xerographic image forming device. A learning algorithm is also applied using a correlated model of system dynamics to compensate for torque disturbances in mechanical systems, such as, for example, transfer subsystems, in image forming devices.

U.S. Pat. No.7,444,101, entitled "Systems and methods for improving belt motion and color registration in an image forming device" by James Calamita, which is commonly assigned, discloses a method and system of correcting a medium velocity error in a photoreceptor belt of an image forming device with a controller. A velocity error of the photoreceptor belt is measured when the medium is used in the image forming device, the velocity error comprising a velocity error due to the image forming device dynamics and a velocity error due to torque disturbance on the photoreceptor belt. A high frequency velocity error is filtered from the measured velocity error, removing the velocity error due to the image forming device dynamics from the measured velocity error to produce a remaining velocity error. The remaining velocity error is converted to torque disturbance. A correction factor is determined on the basis of the torque disturbance, and the medium velocity factor is corrected on the basis of the determined correction factor.

U.S. Pat. No. 7,157,873, entitled "Systems and Methods for Reducing Torque Disturbance in Devices Having an Endless Belt" by Kevin M. Carolan, which is commonly assigned, discloses a control system to compensate for motion disturbances which may cause defects in multi-color output images produced by image forming devices. The system may include a controller that determines when a torque disturbance is expected to occur and controls the photoreceptor belt motor drive unit with a compensation amount that may be retrieved from a data structure. This compensation amount from the data structure may be adjusted via a gain factor and may be combined with the output of a closed loop compensator at a summation point, to attempt to minimize the misregistration effect produced by the torque disturbance in the output images produced by the image forming device. A timing methodology is employed to anticipate the onset of a disturbance, and via the controller, attempts to insert an opposing profile that causes the photoreceptor belt motor drive unit to generate an opposing torque to substantially nullify the disturbance. The amplitude of a correction profile, corresponding to the amplitude of the disturbance, is manually adjusted to attempt to minimize the effects of the disturbance on the produced output images, for example, the color-to-color registration error. The controller monitors the onset of the disturbance or predicts the onset of the disturbance based on sensed photoreceptor belt position and encoder timing. Correction factors for the current operating state of the transfer subsystem in the image forming device are obtained substantially through a trial and error method.

SUMMARY

Embodiments provide methods for correcting misregistration effects of a movable image carrier in an image forming device, that include measuring an actual velocity and a location of the movable image carrier at each of a plurality of successive time intervals. For each measured actual velocity, the measured actual velocity of the movable image carrier is subtracted from a target velocity of the movable image carrier to generate an error signal. Each error signal is processed by a controller transfer function to generate a torque signal. Each torque signal, in combination with a corresponding periodic disturbance signal, produces a net torque signal. Each net torque signal affects the movable image carrier to produce the actual velocity of the movable image carrier. Over time, the error converges to an average value of 0. Thus, misregistration effects due to the disturbance signal are cancelled.

The disclosed systems and methods are not limited to photoreceptors, and thus are useable with intermediate transfer belts that are not necessarily photoconductive. In embodiments, the disclosed systems and methods can be used to correct misregistration effects involving photoreceptors and/or intermediate transfer belts (ITBs). In embodiments, the moving image carrier can be a belt or a drum.

The periodic disturbance signals can result from impacts of successive recording mediums with the movable image carrier and, further, the recording mediums impacting the movable image carrier can be part of a same print job.

The methods can further include the steps of determining a set of one or more characteristics of the print job and/or the recording media of the print job; and, once the generated error signals conform to a predetermined criteria, storing the converged compensation parameters, such as the predicted velocities and/or the net torque signals, along with the corresponding movable image carrier locations for all of the time intervals of a cycle of the movable image carrier in association with the set of one or more characteristics.

In embodiments, the predetermined criteria can be a maximum error value applied to all of the error signals of a full cycle of the movable image carrier Further, the set of one or more characteristics includes at least one of: a recording medium weight; a recording medium size; an orientation of the recording mediums relative to the movable image carrier as the recording mediums contact the movable image carrier;

humidity of air surrounding the movable image carrier; a pitch mode of the print job; and a type of coating of the recording mediums.

The disclosed methods can further include receiving a print job to be printed and initializing the compensation system for the print job. A set of one or more characteristics for the print job to be printed is determined. Then, whether any stored set of one or more characteristics match the set of one or more characteristics for the print job to be printed is determined. If a stored set of one or more characteristics matches the set of one or more characteristics for the print job to be printed, the compensation parameters, such as the control torque signals for one cycle of the moving image carrier are retrieved and used as initial values.

In embodiments, the controller transfer function depends on a period of the disturbance signal. Further, once the misregistration effects due to the periodic disturbance signals are cancelled, the methods can include the steps of storing the corresponding converged compensation parameters, such as the control torque signals, for all of the points in a full cycle of the movable image carrier so that the converged compensation parameters can be used for initializing the compensation system for future print jobs.

Embodiments provide systems for correcting misregistration effects of a movable image carrier in an image forming device. The systems include a sensor that measures an actual velocity and a location of the movable image carrier at each of a plurality of successive time intervals. The systems further includes a first combining unit that subtracts a corresponding actual velocity of the movable image carrier from a target velocity of the movable image carrier to generate an error signal. The systems further include a controller that generates a control torque signal by processing the error signal by a controller transfer function. The systems can include, in a variation, an actuator that applies the control torque signal to the movable image carrier. Alternatively, the systems can include a controller that uses the control torque signal as a set point to control the movable image carrier. The systems cancel the misregistration effects due to a periodic disturbance signal.

In an embodiment, the periodic disturbance signals in the systems can result from impacts of successive recording mediums with the movable image carrier, and, further, the recording mediums impacting the movable image carrier can be part of a same print job.

In an embodiment, the system can further include a determining unit that determines a set of one or more characteristics of a print job and/or the recording mediums of the print job; and a storing unit that, once the generated error signals conform to a predetermined criteria, stores the converged compensation parameters and the corresponding movable image carrier locations for all of the time intervals of a cycle of the movable image carrier in association with the set of one or more characteristics. The compensation parameters that are stored can include the converged control torque signals. In an embodiment, the predetermined criteria can be a maximum error value applied to all of the error signals of a full cycle of the movable image carrier.

In an embodiment, the set of one or more characteristics includes at least one of: a recording medium weight; a recording medium size; an orientation of the recording mediums relative to the movable image carrier as the recording mediums contact the movable image carrier; humidity of air surrounding the movable image carrier; a pitch mode of the print job; and a type of coating of the recording mediums.

In an embodiment, the systems can further include components to initialize the compensation system. A communications interface receives a print job to be printed. A characteristic determining unit determines a set of one or more characteristics for the print job to be printed. A retrieval unit determines whether any stored set of one or more characteristics matches the set of one or more characteristics for the print job to be printed, and, if a stored set of one or more characteristics matches the set of one or more characteristics for the print job to be printed, retrieves the converged compensation parameters, which can be control torque signals, and movable image carrier locations associated with the matching, stored set of one or more characteristics. In this embodiment, the stored compensation parameters are then used as controller initial values.

In further systems, the controller transfer function depends on a period of the disturbance signals. The disclosed systems can further include a storing unit that, once the misregistration effects due to the disturbance signal are cancelled, stores the corresponding control torque signals for all of the points in a full cycle of the movable image carrier. The disclosed systems can be used in xerographic devices.

EMBODIMENTS

Recording media, when entering and exiting the nip regions of biased transfer belts and biased roll transfer systems, are a significant source of movable image carrier velocity disturbance for belttype movable image carriers and of angular velocity disturbance for roll or drum-type movable image carriers. As used herein, the term "movable image carrier" is any moving image carrier that transfers an image to a recording medium. A movable image carrier can be, for example, a belt-type photoreceptor, a belt-type intermediate image transfer belt, a drum-type photoreceptor, and a drum-type intermediate image transfer drum. For a given process speed, the disturbance magnitude can be dependent on many characteristics, including the recording medium type; recording medium condition; recording medium weight; recording medium size; coating of the recording medium; orientation of the recording medium relative to the movable image carrier as the recording medium contacts the movable image carrier; humidity of air surrounding the movable image carrier; and pitch mode of the print job.

The disturbance errors to the velocity or angular velocity profile due to the recording media manifest themselves as image registration errors. It is essential to minimize registration errors to maintain the highest image quality (IQ). Further, acceptable misregistration errors are becoming subject to ever tightening specifications as process speeds of imaging devices become faster and as the specifications of the processes of the imaging devices are required to meet tighter specifications. Methods and systems for correcting the disturbances due to recording media entering and exiting the nip regions of movable image carriers that can achieve fast correction to narrow tolerances are disclosed herein.

Figure 1:
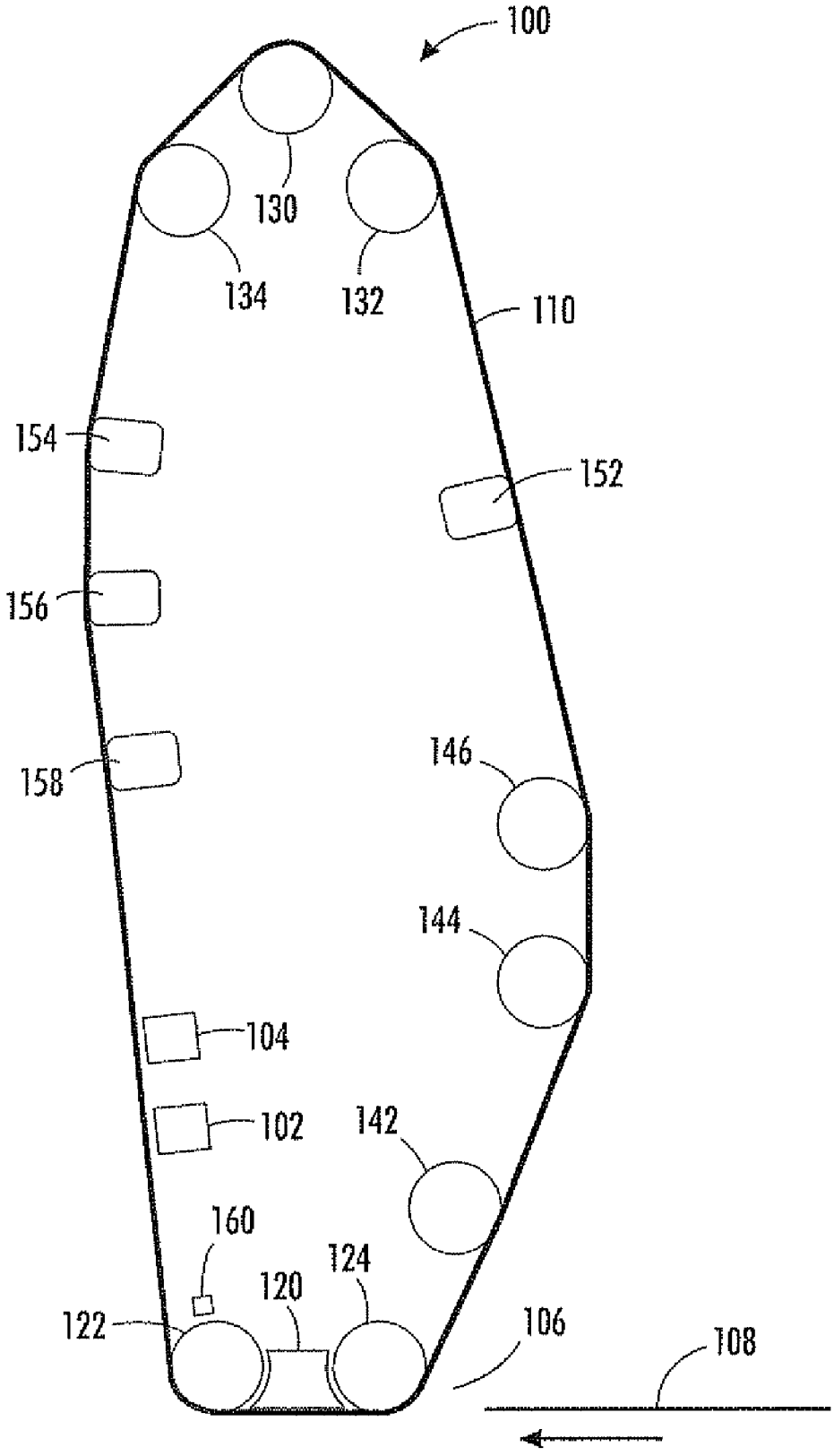
FIG. 1 illustrates a schematic side elevation view of a transfer subsystem for an image forming device including a seamed photoreceptor belt.

As used herein, the "position" and "location" of a movable image carrier is defined as a specific orientation of the movable image carrier. For example, if a drum movable image carrier is used, a position or location of the drum movable image carrier refers to a specific angular orientation of the movable image carrier. If the movable image carrier is a belt-type movable image carrier, a position or location of the belt-type movable image carrier refers to the movable image carrier being at a particular point in the cycle of the movable image carrier. For example, a seam 115 (FIG. 2) will be at a particular location in the cycle of the movable image carrier. As used herein, a movable image carrier cycle is one complete revolution of the movable image carrier. As used herein, the term actuator refers to any active element that is controlled as part of the control system that compensates to remove velocity errors from a movable image carrier. Disclosed actuators include, for example, movable image carrier belt motor drive unit 122 (FIG. 1). As used herein, the terms "unit" and "device" are hardware components or subcomponents of an image forming device that may execute software.

Figure 2:
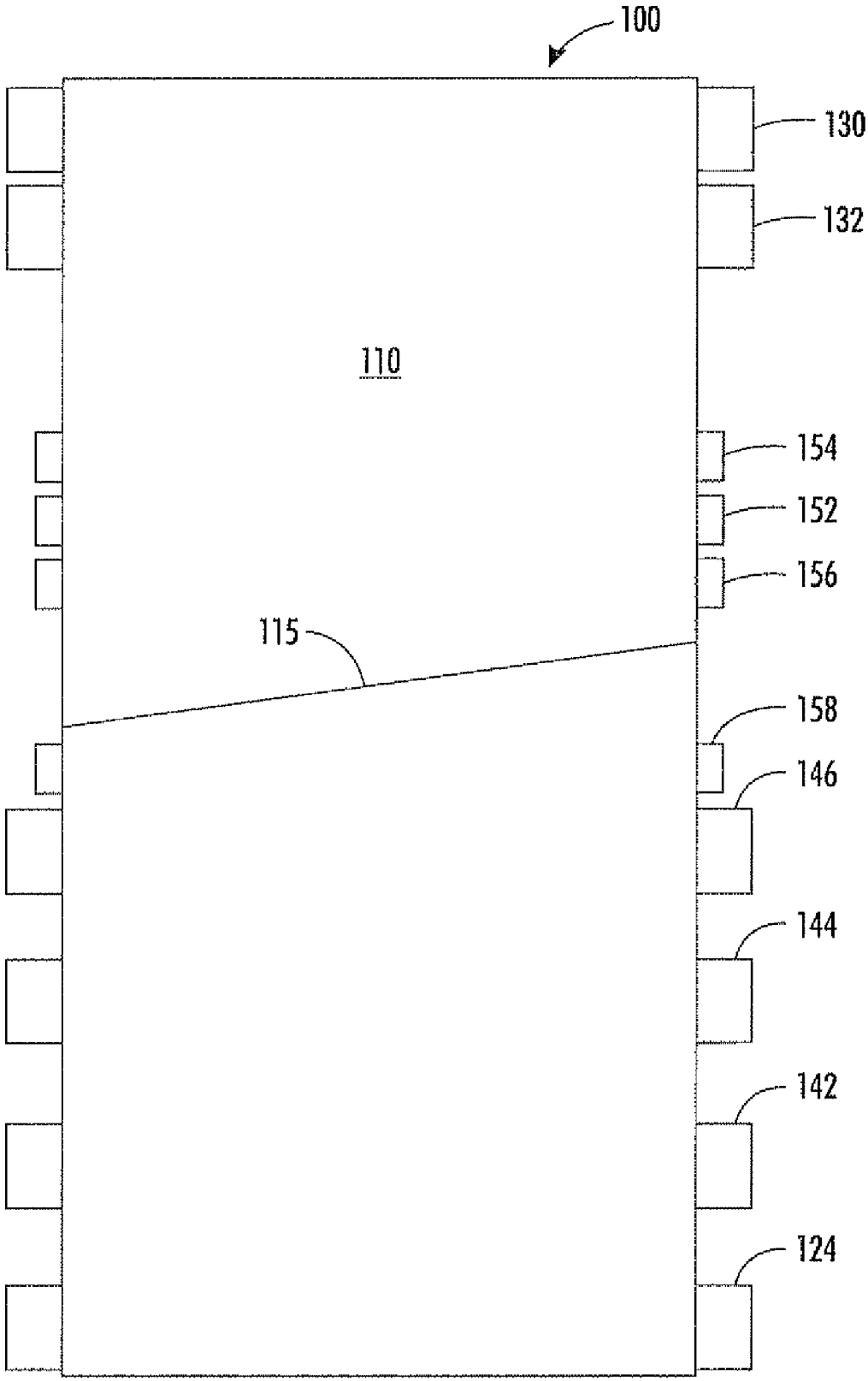
FIG. 2 illustrates a schematic front elevation view of a transfer subsystem for an image forming device including a seamed photoreceptor belt.

FIGS. 1 and 2 illustrate a side elevation view and a front elevation view, respectively, of a transfer subsystem 100, which includes a movable image carrier belt 110, a sensor 102 that senses the velocity of the movable image carrier belt 110, and a sensor 104 that senses the location of the movable image carrier belt 110. A movable image carrier belt motor drive unit 122 engages the movable image carrier belt 110 and moves the movable image carrier belt 110 across a series of support rollers 124, 130, 132, 134, 142, 144, 146, and/or a plurality of non-rotating support bars 152, 154, 156, 158. Movable image carrier belt 110 has a seam 115, formed to join the ends of the movable image carrier material to produce the movable image carrier belt 110. Al acoustic transfer assist (ATA) unit 120 can be used to vibrate the movable image carrier belt 110 to help transfer image toner to recording media, such as recording media 108. The arrow in FIG. 1 shows the direction that the recording medium 108 takes through the imaging device.

Nip region 106 lies at the junction between the movable image carrier belt 110 and the path of incoming recording media. It is at a nip region 106 that recording medium 108, such as a sheet of paper, first contacts the movable image carrier belt 110, causing an impact that translates into a velocity disturbance in the movable image carrier 10 that, in turn, can cause misregistration of images on the recording medium. A sensor 160 measures the resistance of the movable image carrier belt 110 presented to the motor 122, such as results from impacts of recording media 108 against the movable image carrier belt 110. While sensor 160 is located at the motor 122, sensor 160 could be located elsewhere, such as at one of the support rollers 124, 130, 132, 134, 142, 144, 146, or, in an embodiment, could directly measure the movable image carrier belt 110.

Figure 3:
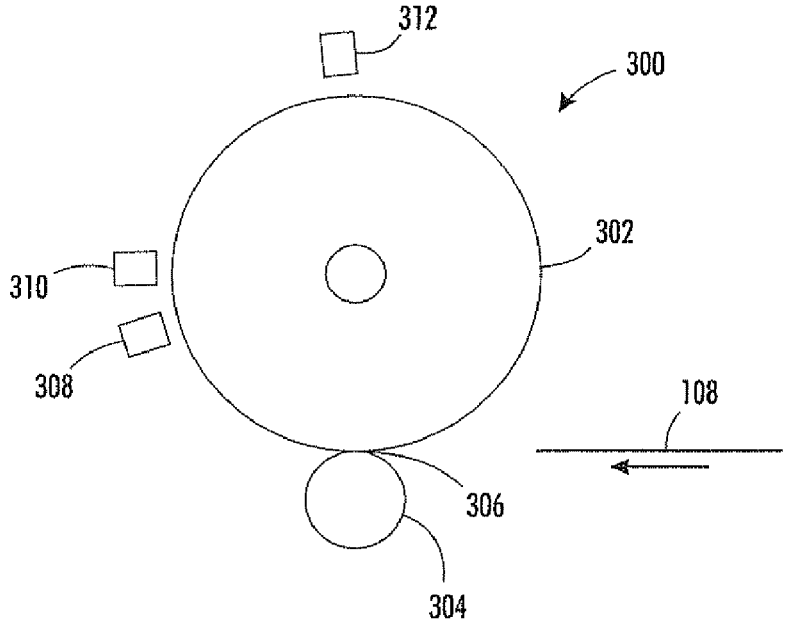
FIG. 3 illustrates a schematic side elevation view of a transfer subsystem for an image forming device including a photoreceptor drum.

FIG. 3 illustrates a schematic side elevation view of a transfer subsystem 300 for an image forming device including a movable image carrier drum 302 and transfer roller 304. Nip region 306 lies at the junction between the movable image carrier drum 302 and the transfer roller 304. A sensor 308 measures the velocity of movable image carrier drum 302 and a sensor 310 measures the location (angle) of movable image carrier drum 302. Transfer roller 304 presses the recording medium 108 against the movable image carrier drum 302 so that the recording medium 108 has toner representing one or more images transferred to it. It is at the nip region 306 that recording medium 108, such as a sheet of paper, first contacts the movable image carrier 302, causing an impact that translates into a velocity disturbance in the movable image carrier 302 that, in turn, can cause misregistration of images on the recording medium. A sensor 312 measures the resistance of movable image carrier drum 302 that is presented to the motor driving movable image carrier drum 302. Such resistance includes the results of impacts of recording media 108 against the movable image carrier drum 302. In an embodiment, sensor 312 can directly sense the movable image carrier drum 302. The arrow in FIG. 3 shows the direction that the recording medium 108 tales through the imaging device.

Figure 4:
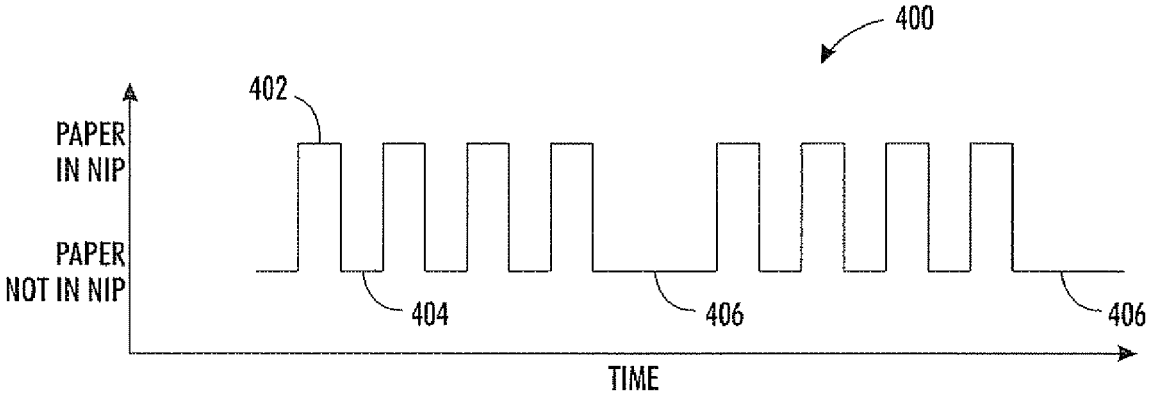
FIG. 4 is a graph showing the times that recording media are in the nip region of a photoreceptor operated in a four pitch mode.

FIG. 4 is a graph of a curve 400 showing the times that recording media are in the nip region of a movable image carrier operated in a four pitch mode. The nip region of a movable image carrier is the region where the movable image carrier and recording medium transport subsystem meet and where the recording media first contact the movable image carrier. The cycle of a movable image carrier is one revolution of the movable image carrier. The pitch mode of a movable image carrier is defined by the number of recording media that are carried on the movable image carrier beginning at a point on the movable image carrier, traversing the surface of the movable image carrier in the process direction, and ending at the same point on the movable image carrier. In FIG. 4, for example, the movable image carrier carries four recording media in each cycle of the movable image carrier. However, the pitch mode of a movable image carrier can change with recording media size and orientation, for example.

In curve 400, the segments 402 illustrate the times that a recording medium is in the nip region of the movable image carrier; segments 404 illustrate the times when a recording medium is not in the nip region; and segment 406 is a special case of segment 404 that illustrates the time, for movable image carrier belts, that the seam 115 passes through the nip region.

As shown in FIG. 4, the interactions of recording media with the nip region of a movable image carrier are generally periodic. That is, the velocity disturbance to the movable image carrier due to recording media interactions is periodic. Thus, the velocity disturbances can be compensated for by using a repetitive controller.

Figure 5A:
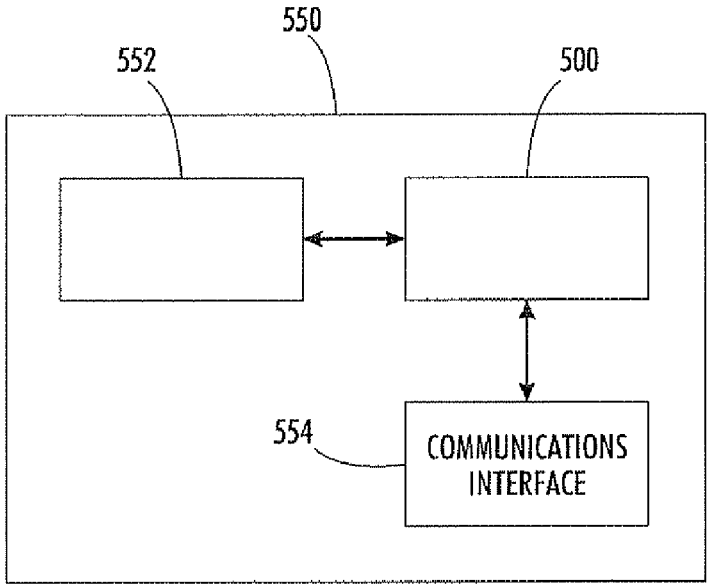
FIG. 5*a* is a block diagram of an imaging system.

FIG. 5*a* is a block diagram of an imaging device 550 incorporating a compensation system 500, memory 552, and communications interface 554. Memory 552 can store the instructions of any program, programs, or modules that implement the components of compensation system 500, discussed below. Memory 552 can further store any variables and constants needed in the processing carried out by compensation system 500. In an embodiment, memory 552 can include a reading/writing device that can write to and/or read from a portable computer-readable medium. The portable computer-readable medium can store the instructions of any program, programs, or modules that implement the components of compensation system 500 and/or can be used to provide the instructions of any program, programs, or modules used to perform maintenance on, or provide updates to, the compensation system 500. Communications interface 554 interfaces with an external device to send and receive communications, including receiving of print jobs for printing on the imaging device 550.

Figure 5B:
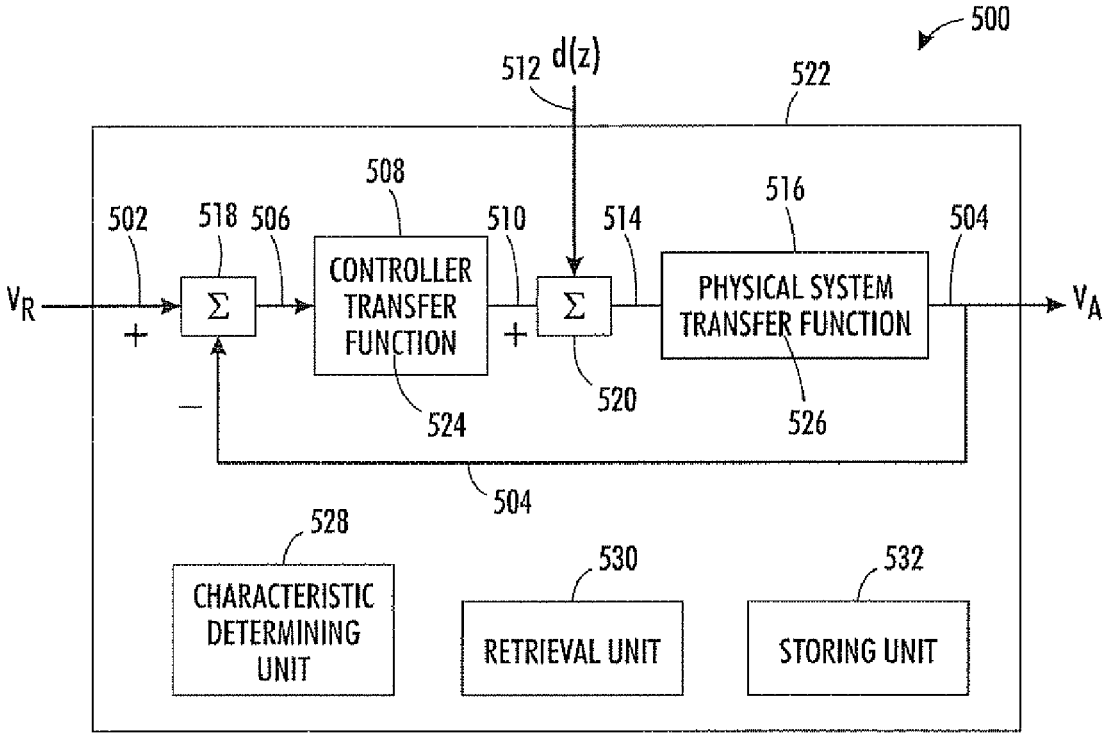
FIG. 5*b* is a block diagram of a control system for correcting misregistrations.

FIG. 5*b* is a block diagram of a compensation system 500 that includes a repetitive controller implemented on processor 522. The compensation system 500 includes a first combining unit 518, a controller 508, a physical system 516, a characteristic determining unit 528, a retrieval unit 530, and a storing unit 532. The compensation system 500 can be expressed in the z domain. That is, compensation system 500 operates by sampling velocities and locations of the movable image carrier at discreet time intervals (z is a time shift operator, a common modeling notation in the art of control systems design) and by calculating the necessary torques to to be applied to the movable image carrier. As discussed in more detail hereafter, compensation system 500 may sense velocities and positions of the movable image carrier at 6000 points in every cycle of the movable image carrier, but other numbers of points per cycle of the movable image carrier can be used.

In more detail, an actual velocity $V_A(z)$ 504 is subtracted from a reference or target velocity $V_R(z)$ 502, such as by first combining unit 518, to generate error signal e(z) 506. Actual velocity $V_A(z)$ 504 is the actual velocity of the movable image carrier measured by sensor 102/308 at time z. The reference or target velocity $V_R(z)$ 502 is a target velocity of the movable image carrier. In an embodiment, $V_R(Z)$ 502 is a constant. However, $V_R(Z)$ 502 can be changed to a value that is selected based on print job and/or environmental characteristics. Error signal e(z) 506 is input to controller 508.

The controller 508 processes the error signal e(z) 506 by the controller transfer function 524 to generate the control torque $t_C(z)$ 510. The control torque $t_C(z)$ 510 is applied by the compensation system 500 to drive the movable image carrier. Reference character 520 indicates that the control torque $t_C(z)$ 510 in combination with the disturbance signal d(z) 512, resulting from interactions of recording media 108 with the movable image carrier, will both affect the velocity of the movable image carrier. The disturbance signal d(z) 512 is the disturbance due to the impact of a recording medium in the nip region of the movable image carrier. The control torque $t_C(z)$ 510 is the torque value actually used to drive the movable image carrier and is supplied as a control signal, for example, to drive unit 122. The control torque $t_C(z)$ 510, in combination with the disturbance signal d(z) 512, is the net torque $t_N(Z)$ 514 that operates on the movable image carrier. The net torque $t_N(Z)$ 514 is the torque value experienced by the movable image carrier.

The control torque $t_C(z)$ 510 is the torque generated by the compensation system 500 to drive the movable image carrier and, when equilibrium is being approached, or is achieved, will already incorporate a compensating torque to counteract the disturbance d(z) 512.

In variations, the control torque $t_C(z)$ 510 can be used as a torque set point used to drive the movable image carrier. As used herein, set points are limits on the range of permissible drive signals that can be applied to an actuator, such as the motor that drives the movable image carrier. In an embodiment, when set points are used as hard set points, a drive signal that exceeds a set point is limited to being within a range defined by at least one set point. That is, if a drive signal exceeds the acceptable range of values, the drive signal will be limited to the nearest set point. In an embodiment, when set points are used as soft set points, a drive signal that exceeds a set point is further processed by an algorithm such that the drive signal is limited to the nearest set point, or, if the drive signal is allowed to exceed the set point, the amount that the drive signal exceeds the set point is reduced. Generally, however, using control torque $t_C(z)$ 510 as a set point instead of the direct signal applied to the movable image carrier likely will result in longer convergence times. For a belt type movable image carrier, the control torque $t_C(z)$ 510 is not applied directly to the movable image carrier, but is applied to motor 122, for example, or to one or more drive rollers that drive the movable image carrier. The net torque $t_N(z)$ 514 is received by the physical system 516, modeled by the movable image carrier transfer function 528. The actual velocity $V_A(z)$ 504 of the movable image carrier is then measured Processor 522 is a computer processing device able to execute computer processing to implement the disclosed functions. Processor 522 can be any computer processing device capable of implementing the functions disclosed herein. For example, processor 522 can be a central processing unit (CPU), an application specific integrated circuit (ASIC), or any other electronic device or circuitry capable of implementing the disclosed operations. Alternatively, or additionally, the processor 522 can be a distributed processing device with components distributed within an imaging device. Alternatively, or additionally, the processor 522 can be linked to a network, such as an intranet or the Internet, to cooperate with other components or processing devices external to the imaging device. Alternatively, or additionally, the imaging device can have multiple processors 522 or can have one or more multi-core processors 522. Thus, the functionality disclosed for the processor 522 can be distributed between two or more processors 522, each of which can be implemented as described above.

While the first combining unit 518, controller 508, characteristic determining unit 528, retrieval unit 530, and storing unit 532 are shown as part of processor 522, any one or any subset of these components can be implemented on a separate processor 522 as discussed above.

In embodiments, the controller 508 has a controller transfer function 524 of the general form:

$$\frac{Cn(z)z^N}{Cd(z)(z^N-1)} \tag{1}$$

where Cn(z) is a filter equation that is a polynomial of z; z is the discrete time variable that indicates a time shift operation; N is the period of the disturbance; and Cd(z) is a filter equation that is a polynomial of z.

In embodiments, the physical system 516 models the movable image carrier and related operating structure by a physical system transfer function 528, common in the art of linear systems, having the general form:

$$\frac{Pn(z)}{Pd(z)} \tag{2}$$

where Pn(z) and Pd(z) are filter equations of z. Stability of compensation system 500 can be controlled by suitably choosing Cn(z) and Cd(z). As the movable image carrier traverses multiple cycles, the compensation system 500, provided the controller 508 is stable, will be such that e(z) will asymptotically converge to 0. Repetitive control techniques typically have long convergence times before achieving a zero steady state error, often requiring times that are many multiples of the period of the disturbance being corrected. This occurs because low gains are generally required in order to assure stability in the presence of un-modeled dynamics. In some high speed repetitive systems, such as disk drives where the period of the disturbance is on the order of a millisecond, such convergence times may not be problematic.

However, in xerographic imaging systems, where a cycle of the movable image carrier is generally on the order of one or more seconds, faster convergence times are essential to minimize customer wait times. In order to address longer potential convergence times of the repetitive controller, the compensation parameters, such as the control torques $t_C(z)$ 510, for one complete cycle of the movable image carrier, can be stored by storing unit 532 into a memory such as memory 552 with the corresponding locations of the movable image carrier and with the characteristics of the print job and recording media used. That is, the set of compensation parameters and corresponding movable image carrier locations can be stored in association with one or more of the recording medium type, recording medium condition, recording medium weight; recording medium size; coating of the recording medium, orientation of the recording medium relative to the movable image carrier as the recording medium contacts the movable image carrier; humidity of air surrounding the movable image carrier; and pitch mode of the print job. The characteristics of the print job and recording media are determined by the characteristic determining unit 528. The characteristic determining unit 528 can determine these values from data input by a user, such as the characteristics of the paper selected by the user, in submitting a print job or from the print job itself which may include data identifying the type of recording media that is to be used.

In these embodiments, when a new print job is received having print job and recording media characteristics that match the print job and recording media characteristics of a stored set of compensation parameters, the matching stored set of compensation parameters can be retrieved by retrieval unit 530 and used to initialize the compensation system 500. The characteristics of the new print job and the recording media to be used for the new print Job can be determined by the characteristic determining unit 528 as discussed above. In these embodiments, the convergence time until zero steady state error can be drastically reduced.

In further variations, if there is no exact match for the print job and recording media characteristics of a new print job and the stored print job and recording media characteristics of any compensation parameters, a set of compensation parameters can be retrieved having print job and recording media characteristics that are determined to be a closest match to the print job and recording media characteristics of the new print job.

Figure 6:
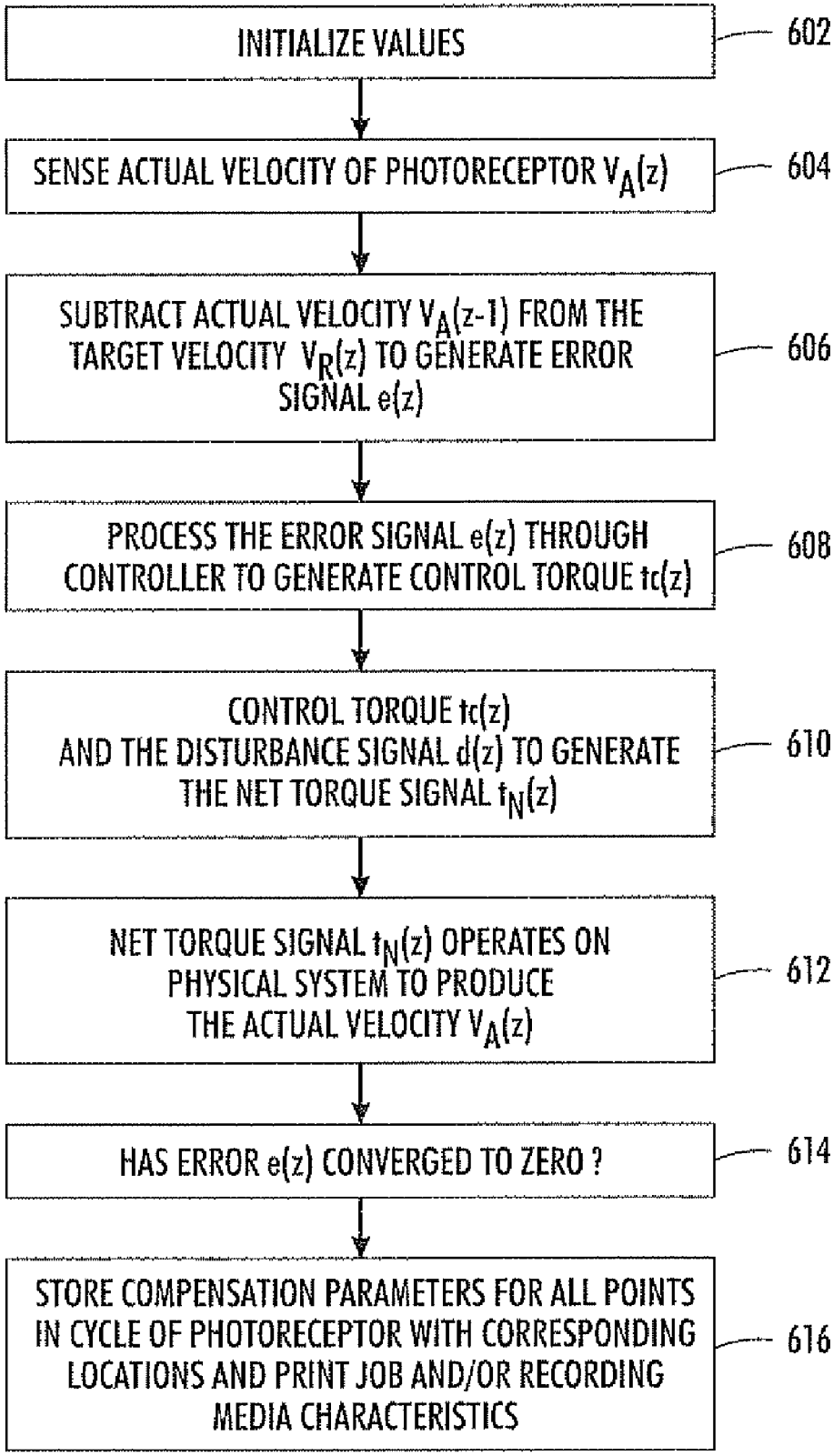
FIG. 6 is a flowchart of a method for correcting misregistrations.

FIG. 6 is a flowchart of a method 600 for correcting misregistrations. At step 602, values used by the compensation system 500 are initialized. Alternately, processor 522 can check if the characteristic parameters of the print job and/or recording media match the characteristic parameters stored in memory 552 and, if so, retrieval unit 530 can retrieve the compensation parameters associated with the matching characteristic parameters to initialize the compensation system 500.

At step 604, an actual velocity $V_A(z)$ 504 of the movable image carrier surface is sensed. For a drum type movable image carrier, such as a drum photoreceptor, the actual velocity $V_A(z)$ 504 can be a tangential velocity of the outer surface of the movable image carrier. For a belt type movable image carrier, the actual velocity $V_A(Z)$ is the linear velocity of the surface of the movable image carrier.

At step 606, the actual velocity $V_A(z)$ 504 is subtracted from the reference or target velocity $V_R(z)$ 502 to generate the error signal e(z) 506. For the initial run in a system not initialized to previously stored compensation variables, the controller internal states and past errors will be initialized to zero. At step 608, the error signal e(z) 506 is processed through the controller 508 to produce the control torque $t_C(z)$ 510.

At step 610, the control torque $t_C(z)$ 510 and the disturbance signal d(z) 512 are combined by the physical system 516. That is, the physical system 516 effectively receives the net torque $t_N(z)$ 514. The velocity of the movable image carrier should be constant, but because of periodic impacts with recording media 108, the velocity is disturbed every time a recording medium 108 enters the transfer nip. The controller generates a signal equal and opposite the disturbance value to cancel out the effect. Disturbances are not sensed directly, but are inferred from other sensor measurements such as the velocity measurements. In embodiments, the disturbance signal d(z) 512 can be determined from other sensed values, such as the velocity of a recording medium just before the recording medium 108 contacts the movable image carrier in the nip region, in combination with characteristics of the recording medium 108, such as the recording medium weight. For example, the disturbance signal d(z) 512 can be sensed indirectly by sensor 160/312 that senses impacts to the movable image carrier by measuring the resistance of the movable image carrier to the motor driving the movable image carrier. In embodiments, the control torque $t_C(z)$ 510 can be used as a set point in driving the movable image carrier, or in other embodiments, the control torque $t_C(z)$ 510 can be used as the actual signal to drive the movable image carrier. In an embodiment, the control torque $t_C(z)$ 510 may be processed by an amplifier. The control torque $t_C(z)$ 510 ultimately is transformed to be an actuator signal to drive the movable image carrier.

At step 612, the net torque $t_N(Z)$ 514 effects the physical system 516 and results in the actual velocity $V_A(z)$ 504 of the movable image carrier. Control then can return to step 604 and continue until the print job ends.

Alternatively, in some embodiments, after step 612 and before returning to step 604, at step 614 it can be determined whether the compensation system has converged to zero. That is, it can be determined if the error signal e(z) 506 has converged to zero. In an embodiment, the test for whether the error signal has converged to zero can be to determine if e(z) 506 is below a predetermined threshold for all points in one cycle of the movable image carrier. That is, if the compensation system measures 6,000 points per cycle of the movable image carrier, the error signal e(z) 506 would be judged to have converged to zero if the error signal e(z) 506 is below a predetermined threshold for each point of a set of 6,000 consecutive points.

At step 616, once it has been determined that the error signal e(z) 506 has converged to zero, the converged compensation parameters can be saved, such as by storage unit 532, in association with the corresponding locations or positions of the movable image carrier and one or more characteristics of the print job and/or the recording media used for the print job. As discussed above, the converged compensation parameters that can be saved can include the control torques. In an embodiment, specifically, the sequence of torque values necessary to regulate the movable image carrier velocity subject to media disturbances, as well as the synchronization information necessary to apply the torques correctly in time for one cycle of the movable image carrier, are stored.

Figure 7A:
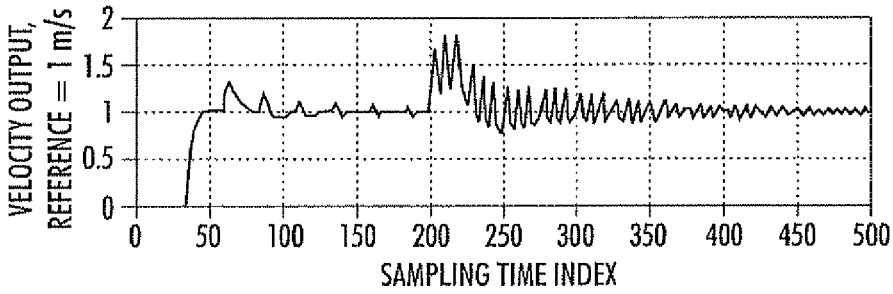
FIG. 7*a* is a graph showing the velocity of a photoreceptor slowing the effect of the impact of a recording medium on the photoreceptor for a system employing the disclosed method of correcting misregistrations.
Figure 7B:
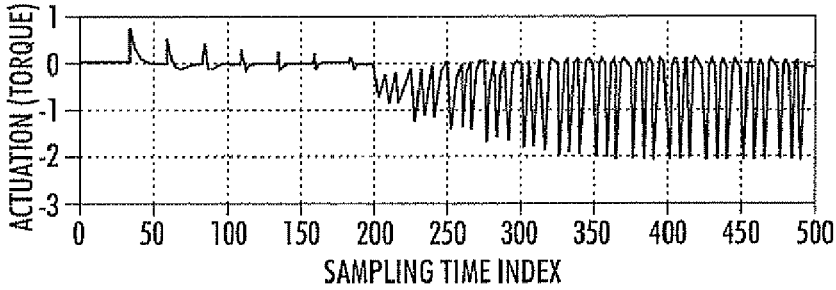
FIG. 7*b* is a graph showing the torque applied to a photoreceptor showing the effect of the impact of a recording medium on the photoreceptor for a system employing the disclosed method of correcting misregistrations.

FIGS. 7*a*-7*b* relate to a first example according to the disclosed misregistration methods. The first example was a print job in which the movable image carrier, a photoreceptor, sped up at time stamp 35 and a disturbance having a period of 25 was imposed beginning at time stamp 200. (The "time stamp" correlates to the "sampling time index" of the horizontal axis in FIGS. 7*a*-7*b*). In FIGS. 7*a*-7*b*, sensor readings were taken at each integer along the time axis. FIG. 7*a* is a graph of the velocity of the photoreceptor showing the effect of the impact of a recording medium on the photoreceptor for a system employing the disclosed method of correcting misregistrations, but without initializing the compensation system 500 to any previously converged set of compensation parameters. As can be seen in FIG. 7*a*, the compensation system 500 converges to zero steady state error in about 200 samples after the disturbance begins. FIG. 7*b* is a graph showing the torque applied to a photoreceptor showing the effect of the impact of a recording medium on the photoreceptor for the first example shown in FIG. 7*a*.

Figure 7C:
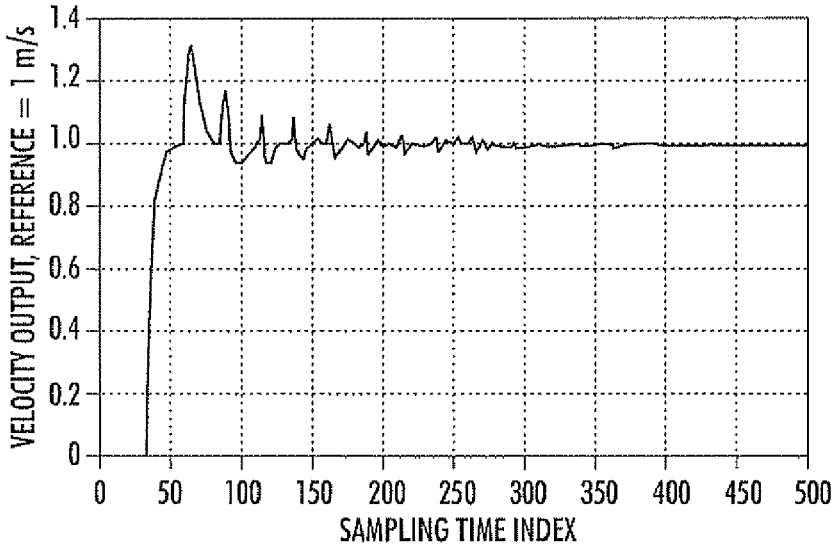
FIG. 7*c* is a graph showing the velocity of a photoreceptor under the conditions of FIG. 7*a* for a system employing the disclosed method of correcting misregistrations that retrieves prior correction system parameters.

FIG. 7*c* shows the results of a second example. FIG. 7*c* is a graph showing the velocity of a photoreceptor under the conditions of FIG. 7*a* for a system employing the disclosed method of correcting misregistrations. However, the compensation system 500 of the example shown in FIG. 7*c* was initialized with prior compensation parameters that resulted for print job and recording media characteristics matching the print job and recording media characteristics of the second example. In the second example, as in the first example, the photoreceptor was sped up at time stamp 35 and the disturbance, having a period of 25, was imposed beginning at time stamp 200. As can be seen in FIG. 7*c*, there is essentially zero convergence time.

It will be appreciated that various of the above-disclosed and other features and functions, or alternatives thereof, may be desirably combined into many other different systems or applications.

What is claimed is:

1. A method for correcting misregistration effects of a movable image carrier in an image forming device, the method comprising:

measuring an actual velocity and a location of the movable image carrier at each of a plurality of successive time intervals;

for each measured actual velocity, subtracting the measured actual velocity of the movable image carrier from a target velocity of the movable image carrier to generate an error signal;

for each error signal, processing the error signal by a controller transfer function to generate a torque signal; and successively applying the torque signal to the movable image carrier, wherein misregistration effects due to a disturbance signal are cancelled.

2. The method of claim 1, wherein the disturbance signal results from impacts of successive recording mediums with the movable image carrier.

3. The method of claim 2, wherein the recording mediums impacting the movable image carrier are part of a same print job.

4. The method of claim 3, further comprising:

determining a set of one or more characteristics of the print job and/or the recording mediums of the print job; and once the generated error signals conform to a predetermined criteria, storing the torque signal and the corresponding movable image carrier locations for all of the time intervals of a cycle of the movable image carrier in association with the set of one or more characteristics.

5. The method of claim 4, wherein the predetermined criteria is a maximum error value applied to all of the error signals of a full cycle of the movable image carrier.

6. The method of claim 4, wherein the set of one or more characteristics includes at least one of: a recording medium weight; a recording medium size; an orientation of the recording mediums relative to the movable image carrier as the recording mediums contact the movable image carrier; humidity of air surrounding the movable image carrier; a pitch mode of the print job; and a type of coating of the recording mediums.

7. The method of claim 4, further comprising:

receiving a print job to be printed;

determining a set of one or more characteristics for the print job to be printed;

determining whether any stored set of one or more characteristics matches the set of one or more characteristics for the print job to be printed;

if a stored set of one or more characteristics matches the set of one or more characteristics for the print job to be printed, retrieving the torque signals and movable image carrier locations associated with the matching, stored set of one or more characteristics and using the retrieved values as initial values.

8. The method of claim 1, wherein the controller transfer function depends on a period of the disturbance signal.

9. The method of claim 1, further comprising:

once the misregistration effects due to the disturbance signal are cancelled, storing the corresponding control torque signals for all of the points in a full cycle of the movable image carrier.

10. A system for correcting misregistration effects of a movable image carrier in an image forming device, the system comprising:

a sensor that measures an actual velocity and a location of the movable image carrier at each of a plurality of successive time intervals;

a first combining unit that subtracts a corresponding measured actual velocity of the movable image carrier from a target velocity of the movable image carrier to generate an error signal;

a controller that generates a torque signal by processing the error signal by a controller transfer function; and an actuator that applies the torque signal to the movable image carrier, wherein misregistration effects due to a disturbance signal are cancelled.

11. The system of claim 10, wherein the disturbance signals result from impacts of successive recording mediums with the movable image carrier.

12. The system of claim 11, wherein the recording mediums impacting the movable image carrier are part of a same print job.

13. The system of claim 12, further comprising:

a determining unit that determines a set of one or more characteristics of the print job and/or the recording mediums of the print job; and a storing unit that, once the generated error signals conform to a predetermined criteria, stores the torque signals and the corresponding movable image carrier locations for all of the time intervals of a cycle of the movable image carrier in association with the set of one or more characteristics.

14. The system of claim 13, wherein the predetermined criteria is a maximum error value applied to all of the error signals of a full cycle of the movable image carrier.

15. The system of claim 13, wherein the set of one or more characteristics includes at least one of: a recording medium weight; a recording medium size; an orientation of the recording mediums relative to the movable image carrier as the recording mediums contact the movable image carrier; humidity of air surrounding the movable image carrier; a pitch mode of the print job; and a type of coating of the recording mediums.

16. The system of claim 13, further comprising:

a communications interface that receives a print job to be printed;

a characteristic determining unit that determines a set of one or more characteristics for the print job to be printed;

a retrieval unit that determines whether any stored set of one or more characteristics matches the set of one or more characteristics for the print job to be printed, and, if a stored set of one or more characteristics matches the set of one or more characteristics for the print job to be printed, retrieves the torque signals and movable image carrier locations associated with the matching, stored set of one or more characteristics and uses the retrieved values as initial values.

17. The system of claim 10, wherein the controller transfer function depends on a period of the disturbance signals.

18. The system of claim 10, further comprising:

a storing unit that, once the misregistration effects due to the disturbance signal are cancelled, stores the corresponding torque signals for all of the points in a full cycle of the movable image carrier.

19. The system of claim 10, wherein the movable image carrier is a photoreceptor belt.

20. A xerographic device comprising the system of claim 10.

* * * * *